US006322648B2

(12) United States Patent
Rayer et al.

(10) Patent No.: US 6,322,648 B2
(45) **Date of Patent: *Nov. 27, 2001**

(54) PYROTECHNIC ACTIVE MASS WITH IGNITION AND COMBUSTION ACCELERATOR

(75) Inventors: Peter Rayer; Klaus Hieke, both of Neuenburg/Baden; Markus Scholz, Anggen, all of (DE)

(73) Assignee: Buck Neue Technologien GmbH, Schneizlreuth (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/296,585

(22) Filed: Apr. 23, 1999

(30) Foreign Application Priority Data

Apr. 23, 1998 (DE) ..... 198 18 337

(51) Int. Cl.[7] ..... C06B 45/20; C06B 45/22; C06B 45/10; C06B 25/18

(52) U.S. Cl. ..... 149/9; 149/11; 149/19.8; 149/96

(58) Field of Search ..... 149/35, 83, 96, 149/9, 10, 11, 19.8; 102/202, 202.5; 264/3.1, 3.4

(56) References Cited

U.S. PATENT DOCUMENTS

| | | | | |
|---|---|---|---|---|
| 3,773,351 | * | 11/1973 | Catanzarite | 280/150 |
| 3,837,942 | * | 9/1974 | Catanzarite | 149/83 |
| 4,381,270 | * | 4/1983 | Bjorn et al. | 264/3 |
| 4,929,290 | * | 5/1990 | Cartwright | 149/35 |
| 5,237,928 | * | 8/1993 | Redecker | 102/431 |
| 5,339,741 | | 8/1994 | Craven et al. . | |
| 5,345,871 | * | 9/1994 | Stang | 102/202 |
| 5,501,152 | * | 3/1996 | Zeuner et al. | 102/292 |
| 5,670,735 | * | 9/1997 | Ortmann et al. | 102/202 |
| 5,847,310 | * | 11/1998 | Nagahashi et al. | 102/202.6 |

FOREIGN PATENT DOCUMENTS

| | | |
|---|---|---|
| 27 37 699 | 3/1979 | (DE) . |
| 2-159198 | 8/1990 | (JP) . |
| 2-159199 | 8/1990 | (JP) . |
| 7-190696 | 7/1995 | (JP) . |

* cited by examiner

*Primary Examiner*—Michael J. Carone
*Assistant Examiner*—Aileen J. Baker
(74) *Attorney, Agent, or Firm*—Burns, Doane, Swecker & Mathis, LLP

(57) ABSTRACT

A pyrotechnical object is made by compressing a pyrotechnical mass, and introducing into the mass an ignition and combustion accelerator in the form of a propellant powder. The propellant powder could be mixed with the mass prior to compression. Alternatively, the propellant powder could be pressed into an ignition surface of the mass after the pressing. The propellant powder may comprise basic cellulose and/or nitro-cellulose.

9 Claims, No Drawings

PYROTECHNIC ACTIVE MASS WITH IGNITION AND COMBUSTION ACCELERATOR

BACKGROUND OF THE INVENTION

The invention relates to a pyrotechnic objects and methods of making them.

Smoke-screening agents, smoke agents, luminescent materials, signal substances, marking substances, etc., are usually classified under the collective term of "active mass." Such active masses exhibit their effect after ignition. Physically and chemically stabile active mass systems, especially in the form of highly condensed pressed objects are, however, often difficult to ignite in practice. In so doing, special difficulties are caused if larger surfaces of pressed objects are to be ignited to achieve a spontaneous active mass effect.

The state of the art is based on that the combustion speed of nitro-cellulose-containing solid propellants increases monotonously with increasing pressure, while the combustion behavior, namely this monotone increase, can be modified, that is, reduced or disrupted, through chemical modification of the nitro-cellulose component, as is described, for example, in German Document No. 27 37 699 (the disclosure of which is being incorporated by reference herein), without describing an increase of the combustion speed or even an ignition acceleration, independent of pressure.

Further, the use of nitro-cellulose powder in the effect-producing firework bodies is well known, especially to effect a smoke-less colored flame formation; see, for example, JP 2-195198-A, JP 2-195199-A and JP 0-7190696-A, or for the breaking off of smaller and larger pieces, see, for example, WO 93/14365. All of those four documents are incorporated herein by reference.

It is the object of the present invention to make possible an improved and faster ignition of a pyrotechnic active mass. In so doing, especially a pyrotechnic active mass should be prepared having ignition and combustion accelerators.

SUMMARY OF THE INVENTION

This problem is solved, according to the invention, through a pyrotechnic active mass, especially in the form of a highly condensed pressed object having an ignition and combustion accelerator in the form of a propellant powder added to the recipe of the pyrotechnic active mass and/or applied onto the ignition surface of the pyrotechnic active mass.

DETAILED DESCRIPTION OF A PREFERRED EMBODIMENT OF THE INVENTION

A pyrotechnic object is formed by compressing a pyrotechnic mass to a highly compressed state. In accordance with the invention, the mass is provided with an ignition and combustion accelerator in the form of a propellant powder. The propellant powder can either be applied onto the ignition surface of the object, and/or mixed into the mass as one of the ingredients.

Furthermore, it is suggested with the invention that preferably from 0.5 to 70 weight percent of propellant, with regard to the weight of the pyrotechnic active mass itself, is added thereto.

The propellant powder can include basic cellulose powder and/or nitro-cellulose powder, according to the invention.

It is preferred, according to the invention, that the propellant powder is reclaimed from disassembled munitions.

Moreover, the problem, according to the invention, is solved through the use of a propellant powder as ignition and combustion accelerators for a pyrotechnic active mass and/or the application of a propellant powder onto the ignition surface of the pyrotechnic active mass.

In so doing, the invention suggests that the propellant powder is pressed and/or treated superficially using solvents, wherein it is preferably pressed along with the pyrotechnic active mass for the formation of a pressed object. The solvent treatment would occur at the interface between the pyrotechnic active mass and the propellant powder to promote a merging of those materials. The materials could be pressed to augment the merging.

Further, it can be provided, according to the invention, that, with regard to the weight of the pyrotechnic active mass, preferably from 0.5 to 70 weight percent of propellant powder preferably including a basic cellulose powder and/or nitro-cellulose powder is used.

It is preferred, according to the invention, that the propellant powder is recycled from disassembled munitions.

Thus, the basis for the invention is the surprising recognition that the propellant powder can be used in pyrotechnic active mass systems to improve, on the one hand, the willingness of the pyrotechnic active mass, in the form of pressed objects, to ignite, wherein even a spontaneous ignition of the active mass can be achieved through large-surface ignition. On the other hand, through the use, according to the invention, of propellant powder in pyrotechnic active mass systems, a combustion acceleration is achieved through the formation of gas canals in the active mass of the propellant powder and through the additional release of energy to the active mass during combustion.

In so doing, propellant powder can be used as ignition aid or for combustion acceleration of various active mass systems, as long as there is a mutual chemical compatibility of the individual components.

The ignition and combustion accelerator, according to the invention, can be successfully used especially with the following pyrotechnic types of charges:

charges on the basis of red phosphorus with an oxygen carrier;

thermite charges; and perchlorate and chlorate charges.

EXAMPLE I

The charge based on red phosphorus includes preferably red phosphorus in the range of from 40 to 80 weight percent, nitrate greater than zero and up to 20 weight percent, Mg powder greater than zero and up to 20 weight percent, propellant charge powder greater than zero and up to 20 weight percent, and a binding agent greater than zero and up to 20 weight percent. The propellant charge powder may comprise basic cellulose powder and/or nitrocellulose powder for example.

EXAMPLE II

The thermite charge includes preferably ferrous-III-oxide in a range of from 20 to 60 weight percent, Mg powder in a range of from 5 to 45 weight percent, the propellant charge powder in a range of from 10 to 50 weight percent and a binding agent greater than zero and up to 10 weight percent.

EXAMPLE III

The perchlorate charge includes preferably perchlorate in a range of from 10 to 50 weight percent, the propellant charge powder in a range of from 30 to 70 percent and a binding agent in the range of from 10 to 30 weight percent.

To obtain highly condensed pressed objects, a pressing pressure of the magnitude of from 500 kg/cm$^2$ to 1500 kg/cm$^2$ is applied.

Propellant powders, especially a monobasic cellulose powder and a nitro-cellulose powder, do not leave any combustion residues, since a nearly 100-percent reaction into gases and energy occurs. Thus, on the one hand, the effect to be actually generated using the active mass is not negatively influenced and, on the other hand, the environment is not unduly burdened.

Especially economically and ecologically, thus, also the use of propellant powder from disassembled munitions which, for example, according to a compatibility examination using heat-flow calorimetry, still has good stability (i.e., a sufficient lifespan) and through recycling, costs are also reduced.

In the above description as well as in the characteristics of the invention, as they are disclosed in the claims, can be significant not only individually but also in random combination for the realization of the invention in its various embodiments.

What is claimed is:

1. A pyrotechnic object comprising a highly compressed pyrotechnic mass, and an ignition and combustion accelerator in the form of a propellant powder mixed into the pyrotechinc mass as one of the ingredients thereof, and wherein an additional amount of the propellant powder is pressed into an ignition surface of the pyrotechnic mass.

2. The pyrotechnic object according to claim 1 wherein the propellant powder constitutes from 0.5 to 70 percent weight of the mass.

3. The pyrotechnic object according to claim 1 wherein the propellant powder comprises basic cellulose powder.

4. The pyrotechnic object according to claim 1 wherein the propellant powder comprises nitro-cellulose powder.

5. The pyrotechnic object according to claim 1 wherein the pyrotechnic mass is pressed at a magnitude in the range of 500 to 1500 kg/cm$^2$.

6. A pyrotechnic object comprising a highly compressed pyrotechnic mass, and an ignition and combustion accelerator in the form of a propellant powder added to the pyrotechnic mass by being pressed only into an ignition surface thereof.

7. The pyrotechnic object according to claim 6 wherein the propellant powder comprises basic cellulose powder.

8. The pyrotechnic object according to claim 6 wherein the propellant powder comprises nitro-cellulose powder.

9. The pyrotechnic object according to claim 6 wherein the pyrotechnic mass is compressed at a magnitude in the range of 500 to 1500 kg/cm$^2$.

* * * * *